US005855401A

United States Patent [19]

Papernik

[11] Patent Number: 5,855,401

[45] Date of Patent: Jan. 5, 1999

[54] DRESSING AID/VALET

[76] Inventor: Karen Papernik, 8 Phillard Ct., Paterson, N.Y. 12563

[21] Appl. No.: 911,258

[22] Filed: Aug. 14, 1997

[51] Int. Cl.[6] ..... A47G 25/90

[52] U.S. Cl. ..... 294/2; 294/3.6; 24/40; 7/123

[58] Field of Search ..... 294/1.1, 2, 3, 3.6, 294/24, 99.2; 24/40; 7/101, 123; 132/75, 75.3, 75.6

[56] References Cited

U.S. PATENT DOCUMENTS

| | | | |
|---|---|---|---|
| 190,488 | 5/1877 | Hicks | 24/40 |
| 228,660 | 6/1880 | Mcdonald | 24/40 |
| 294,284 | 2/1884 | Sommer | 7/123 |
| 339,123 | 3/1886 | Wood | 7/123 |
| D. 363,042 | 10/1995 | Papernik et al. . | |
| 416,932 | 12/1889 | Mabie | 24/40 |
| 1,841,291 | 1/1932 | Kern | 132/75 |
| 2,974,991 | 3/1961 | Gerrick | 294/3.6 |

FOREIGN PATENT DOCUMENTS

| | | | |
|---|---|---|---|
| 79431 | 11/1996 | Canada . | |
| 2650-991 | 11/1978 | Germany | 294/3.6 |
| 298862 | 8/1965 | Netherlands | 294/3.6 |

OTHER PUBLICATIONS

0520–23 1991 Miles Kimbell Catalog, p. 30.
505206 1994 Miles Kimbell Catalog, p. 57.

*Primary Examiner*—Dean Kramer
*Attorney, Agent, or Firm*—Lackenbach Siegel Marzullo Aronson & Greenspan

[57] ABSTRACT

A personal dressing device/valet having dressing aids, comprising a pair of end caps, and an intermediate element having at least one compartment, and having opposite ends, and at least one of the end caps being removably securable to one of the opposite ends. One of the end caps of the pair of end caps having a clamping mechanism comprising a pair of jaws for assisting in fastening a bracelet to one's wrist; and the at least one end cap having another dressing aid selected from the group consisting of a zipper pull, button threader, emory board, magnifying glass and combinations thereof.

20 Claims, 3 Drawing Sheets

DRESSING AID/VALET

This invention relates to a compact, personal dressing kit/aid or dressing valet for a user, such as a woman or arthritic-handicapped individuals, and more particularly to a small, neat and fashionable, multi-functional dressing tool that performs a plurality of functions all in one device, such as assisting in zippering up and/or down a garment, "threading" a button through a button hole, and assisting in fastening a bracelet around one's wrist. Other dressing/grooming accessories may include an emery board and/or a magnifying glass which assists in viewing small objects, such as jewelry clasp and other findings commonly found in jewelry.

BACKGROUND OF THE INVENTION

Heretofore in the marketplace, most if not all personal "dressing tools" generally performed a single function, such as the Zipper Pulls of the Oct. 5, 1993 U.S. patent to Leonardz, U.S. Pat. No. 5,249,832 which includes a one-half inch pipe like rigid handle with a weighted 90° pipe elbow bent at an end thereof and having a magnetized element adjacent an end hook for aiding in precluding a zipper from becoming disengaged from the hook during use in the zipping and unzipping process. U.S. Pat. No. 2,900,205 granted to Cirone on Aug. 18, 1959 discloses a few embodiments of a zipper pull, and all employ a long handle with an arm disposed at right angles thereto at one end. One device employs a finger element of a slide fastener having a spring-loaded slide for use in gripping a zipper pull. Another side actuator is the heavily weighted zipper pull of U.S. Pat. No. 3,249,977, granted May 10, 1996 to Cloud, Jr. While these devices may function adequately, they are generally large and clumsy, usually more complicated and not lightweight nor small enough to fit in small pouch of one's pocket or pocketbook. Another well known single functioning tool is the "Bracelet Buddy" bracelet fastening aid, trademarked and made and sold by Papernik Productions, Inc. of 115 Kisco Avenue, Mt. Kisco, N.Y. 10549. This device while a small and handy to use, is limited to the sole function of aiding one in putting on a bracelet. See for example, the six inch long clasp clamp and jewelry clasp, respectively advertized in two Miles Kimbell catalogs on page 30 (year 1991, item no. 0520-23) and on page 57 (year 1994, item no. 505206); and also my U.S. Design Pat. No. 363,042 patented on Oct. 10, 1995, and U.S. Pat. No. 3,242,540 granted on Mar. 29, 1966 to Michell, as well as the large and clumsy bench type Bracelet Fastening Tools of U.S. Des. Pat. No. 323,132 granted on Jan. 14, 1992 to Gernnan and U.S. Pat. No. 2,926,875 granted on Mar. 1, 1960 to Hoyte.

Other known dressing accessories are button threaders which are similar in design to a "needle threader" wherein a loop or wire-like frame is used to feed or thread one element (thread or button) through a hole in another element (needle or garment).

SUMMARY OF THE INVENTION

It is therefore an object of the invention to provide a personal dressing kit/aid or dressing valet tool which performs multiple functions for aiding a user in dressing and/or grooming oneself.

It is another object of the invention to provide a novel and improved dressing "valet" tool, or butler buddy, not unlike that of a new Swiss army knife, but one that is especially designed for women, except that it is not provided with any knives, screwdriver, can and bottle openers, or the like, but with dressing and/or grooming implements that assist the user with various dressing aids and/or grooming functions, as well as with other miscellaneous tool like functions, such as enabling one to magnify or enlarge small findings, reading material or other illustration and/or objects for improved viewing.

Yet a further object of the invention is to provide a personal dressing tool or valet-butler device which is small and compact, and one which is capable of being carried in a pocket or pocketbook.

Another object of the invention is to provide a personal dressing aid/valet which is provided with removable end caps, and a tubular intermediate element with one or more cavities or hollow interior compartments for retaining and storing in place most of the tool accessories so that they are not visible when not in use.

Still yet another object of the invention is to provide a personal dressing aid/valet which is not only ingenious, and aesthetically pleasing in form, but one which may, if desired, be placed on one's bureau, dresser, desk or any other home furniture or even in the bathroom, without such dressing aid/valet looking out of place anywhere in the home.

DESCRIPTION OF THE PREFERRED EMBODIMENTS

Figure 1:
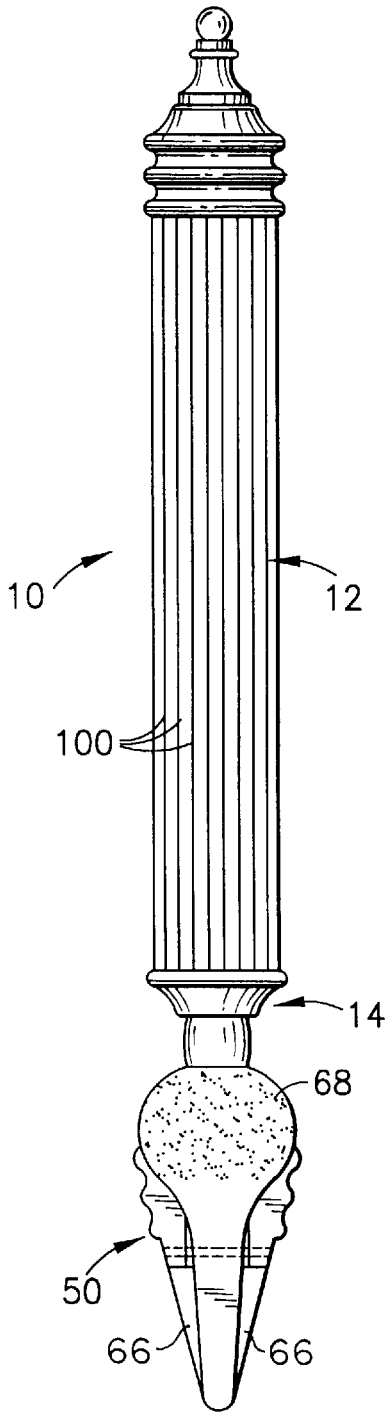
FIG. 1 is a plan view of my dressing aid/valet embodying the invention.
Figure 2:
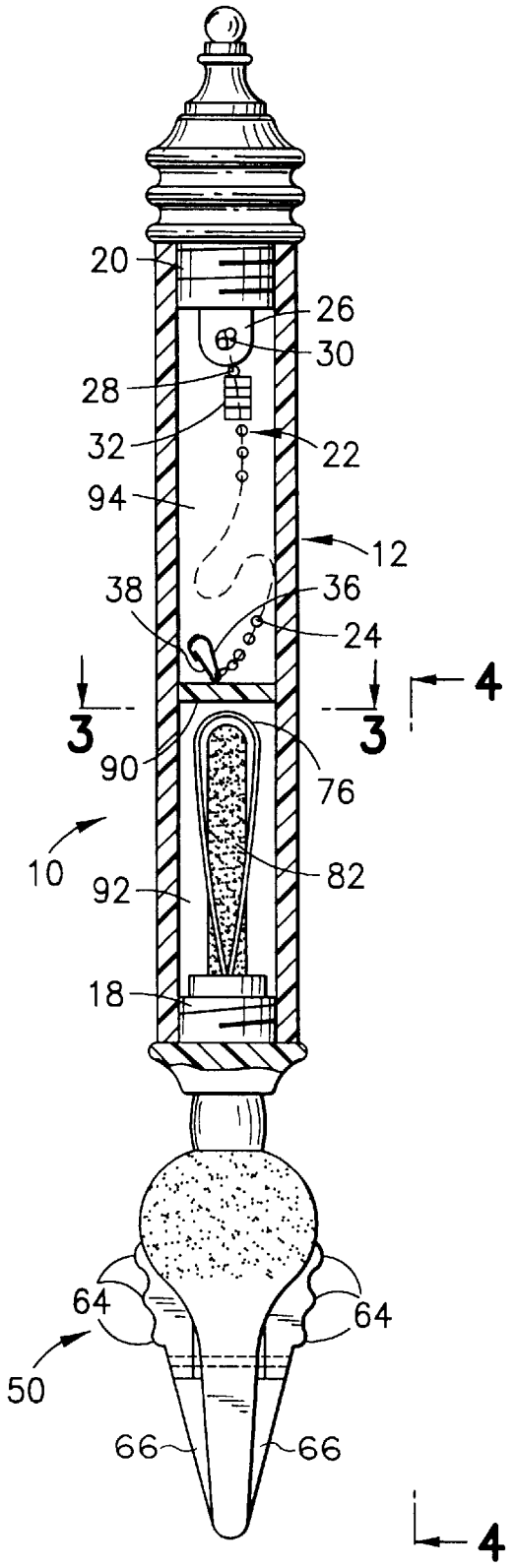
FIG. 2 is a plan view, similar to that of FIG. 1, but with the tubular center portion thereof shown in cross-section.

Referring now to the figures, and particularly to FIGS. 1–2, there is shown my dressing aid/valet 10 comprising an elongated, preferably tubular, intermediate element 12 or central body portion and a pair of end plugs or caps 14, 16, one each for the opposite open ends of the tubular intermediate element 12. The end caps 14, 16 are suitably removably secured to the open ends, by conventional means, such as a friction fit, or as shown by means of mating threads. In the preferred embodiment, the end caps 14,16 have male threads 18,20 engagable with female threads (not shown) on the inside diameter of the opposite open ends of the elongated, intermediate element 12.

At one end of the dressing aid/valet, end cap 16 is shown to preferably be provided with a zipper pull 22, preferably comprising a ball chain 24 as it is capable of fitting into a very small space or compartment. The ball chain 24 is suitably held to a small extension 26 of the end cap 16 where the proximal end 28 of the ball chain 24 is threaded through a hole 30, and such chain end 28 is suitably securely held together with the ball chain 24 by means, such as a crimped ferrule or ring-like element 32. Other suitable securing means, such as adhesives, epoxies, solder, weld and other like fusing methods, etc. may likewise be employed without departing from the invention. In this regard, the elements or parts of the dressing aid/valet (save the emery board and/or magnifying glass) my all be either of metal or plastic. Preferably, the components are of any suitable plastic.

Figure 8:
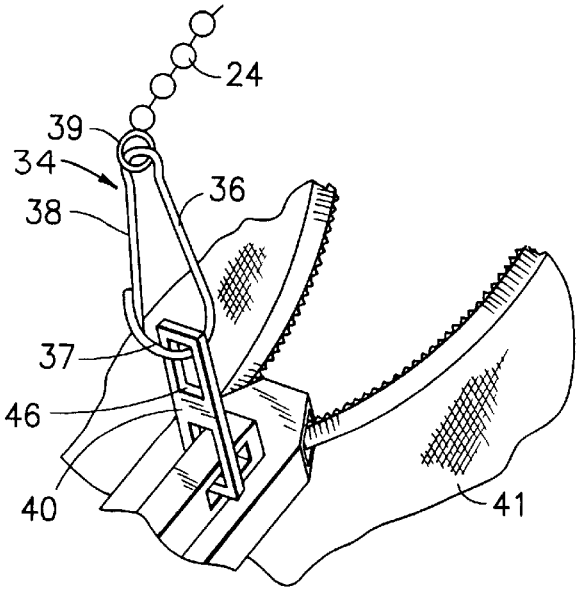
FIG. 8 is a greatly enlarged view of a zipper pull (hook) engaged with the end zipper pull tab or gripper shown in FIG. 7.

At the opposite or distal end 34 of the ball chain 24, as best shown in FIG. 8 a suitable hook-like element 36 having a biasable portion 38 is similarly secured or as shown is looped about a ring 39 provided at the chain's end. It is this biasable portion 38 which is used to enable the hook-like end portion 37 of the element 36 to be removably connected to the zipper pull tab 40 of a conventional zipper 42 of a garment 44. Most zipper pull tabs 40 are normally provided with a small aperture 46. However, with a thin, straight zipper pull devoid of an aperture, then an alternate small clamping device (not shown) with a pair of strongly biased jaws with teeth may be substituted for the hook-like element 36.

Figure 7:
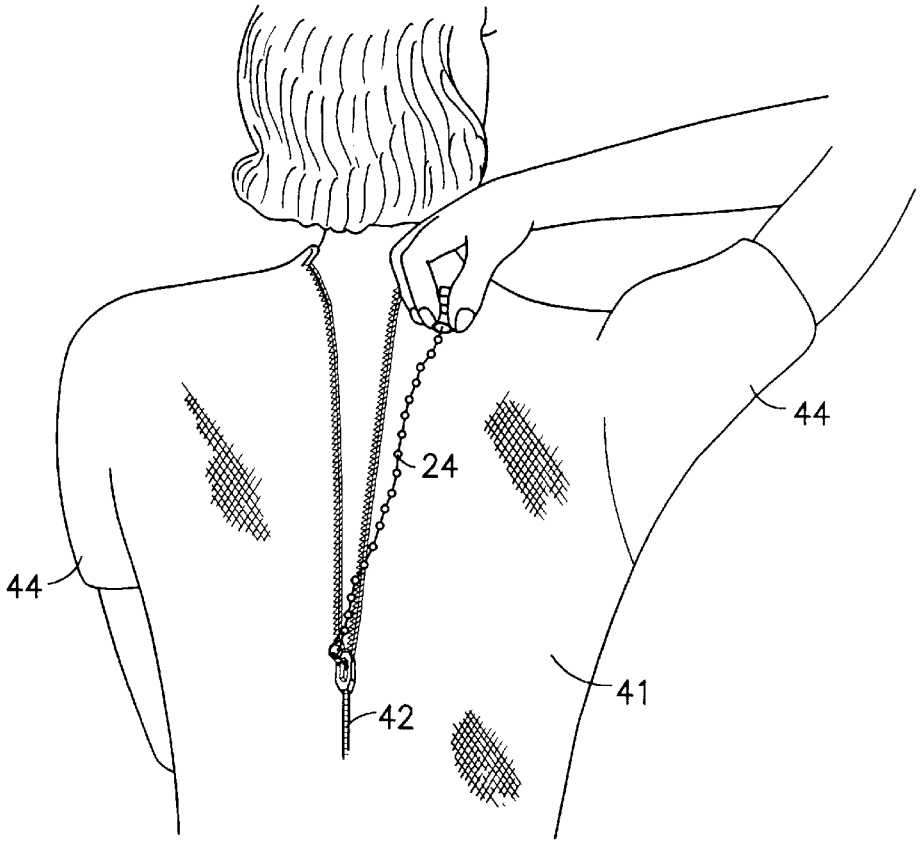
FIG. 7 is a rear view of the upper backside torso of a women, showing use of the zipper pull device or feature of the invention.

In such an arrangement, the jaws would be employed to "bite" the thin zipper pull for pulling same up or down when dressing, as best shown in FIGS. 7–8. As shown therein, the user would just loop the hook-like end portion 37 of element 36 through the aperture 46 in the zipper pull tab 40, and then slip into the garment, shown as a dress 41, and then grab the end plug of the ball chain zipper pull with one's left or right hand and swing same over one's shoulder and proceed to pull the zipper closed. In a like manner, to remove the garment, the user would first with one's hands manipulate the biasable portion 38 so that the hook-like end portion 37 of element 36 engages the aperture 46 of the tab 40, and then releases the biasable portion 38 and simply lets go of the zipper pull which drops by gravity to hang from the closed zipper plug 42. The user then brings either hand behind one's back and grabs the end cap 16 of the ball chain zipper pull 22, and pulls the zipper pull tab 40 down to open the closed zipper 42 completely so the garment 44 can be removed over one's head or dropped to the floor after having first removed one's arms from the sleeve portions of the garment 44.

At the opposite end of the dressing aid/valet 10, a bracelet fastening aid 50 is provided as an extension of end cap 14. As best shown in FIGS. 1–2 and 4–5, the bracelet fastening aid 50 has a fixed jaw 52 and a movable jaw 54, suitably provided with gripping teeth 56, for engaging an end of a bracelet to be worn about one's wrist. The movable jaw 54 is provided with a U-shaped end formed by a biasable prong-like element 53 that is securely positioned on the fixed jaw 52 by means of a pin-like element or rod 58 provided between a pair of parallel, oppositely disposed wings 60 (only one shown) protruding upwardly like walls from the fixed jaw 52. Such wings are further strengthened by means of a plurality of ribs 64 on the sides 66 of the fixed jaw 52.

Figure 4:
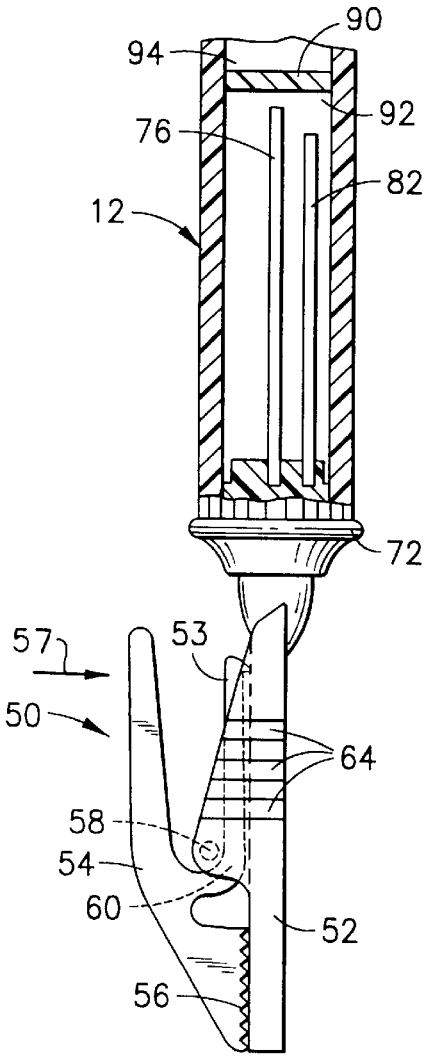
FIG. 4 is an enlarged, partial side elevational view, taken in the direction of viewing line 4—4 shown in FIG. 2, but with the tubular intermediate element shown in section.

As best shown in FIG. 4, depressing the movable jaw 54 in the direction of the reference arrow 57, one can open and close the jaws of the bracelet fastening aid. Movable jaw 54 in this regard is suitably provided with a large thumb depressor 68, suitably having a plurality of dimples or other like gripping means, such as a knurled or grooved gripping surface. Aperture or window 70 in the base of the fixed jaw is provided for assembling the movable jaw to the fixed jaw. Such clamping means is similar to the well known bracelet fastening aid or device marketed under the aforementioned trademark "Bracelet Buddy".

The end cap 14 is also, similarly provided as is end cap 16, with mateable male/female threaded elements for removably securing the end cap 14 to the intermediate element 12.

As shown in FIGS. 1–2 and 4, such end cap 14, while only having a single rib 72 at its end may, if desired, be also provided with a plurality of grooves and ribs just like the opposite end cap 16 for purposes of aesthetics and/or symmetry. Here, however, the overall length of the tool of the invention is minimized, and the tool is of a size that can be grasped and held comfortably in the palm of one's hand while at the same time is small enough to be stored in one's pocket or pocketbook.

Figure 3:
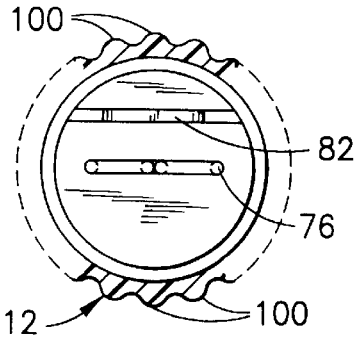
FIG. 3 is a cross-sectional view, taken along line 3—3 of FIG. 2.
Figure 5:
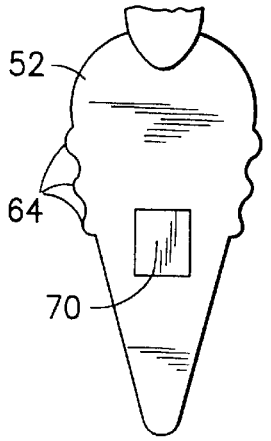
FIG. 5 is an enlarged bottom view of the fixed jaw of a bracelet fastening aid disposed at one end of the dressing aid/valet.
Figure 6:
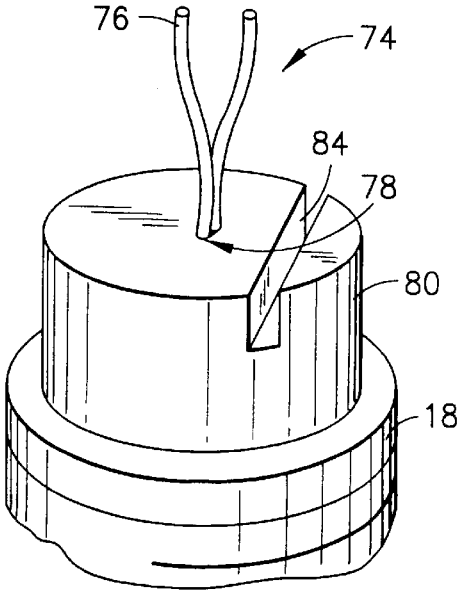
FIG. 6 is an enlarged perspective view, partly broken away, of the end cap embodying the bracelet fastening aid, but showing a button threading tool, and groove means for supporting an optional accessory, such as an emery board or magnifying glass.

The end cap 14 is also suitably provided with one or more dressing aids, such as the button threader 74. The threader 74 is simply a biasable wire loop 76 made of suitable spring metal, and is suitably frictionally or if desired adhesively secured to an aperture 78 in a suitable extension 80 protruding from the thread 18 mateable with the tubular intermediate element 12. Such a device is not much unlike a needle threader, and is conventional and well known. Another aid is a conventional emery board 82 removably (and replenishable as required) held in suitable slot means 84 provided in the extension 80 of end cap 14, as best shown in FIGS. 3 and 6.

If desired, suitable partition means, such as a plug or wall 90 may be provided in the tubular, intermediate element 12 to form separate cavities or compartments 92 and 94. With such construction, the ball chain 22 cannot entangle with the loop 76 of the button threader 74. Alternatively, if desired, a flat sleeve-like element, such as a lay-flat plastic tube (preferably clear) can be slipped over the loop 76 to shield it from the ball chain 22 where only a single compartment or cavity is employed. Similarly, a flat plastic U-shaped guard or knife edge protector may be likewise employed for such purpose.

In addition to the emery board 82, or in another like groove, or separate dove-tail groove on the other side of threader 74, a small plastic magnifying glass, also represented by the same reference numeral 82 in FIG. 4 can be inserted for use. The threader 74 may be removed if necessary, although the viewing area between the loop 76 is more than adequate for viewing an object. If the magnifying glass is desired as a separate optional aid, it may be placed loosely in compartment 92 or be removably secured to suitable alternate slot means in extension 80. A conventional dove-tail groove is preferable where the tool may be subject to rough use. Such type of slot while employing friction to retain the object (magnifying glass) in place, the dove-tail slot is very strong transversely thereof so that such a magnifying viewing glass would be held more solidly in place as compared to a more conventional parallel slot.

The intermediate element 12 is provided with a plurality of elongated, longitudinal ribs 100 running the full length of such element. These ribs provide in assisting one's grip on the dressing aid/valet tool, while strengthening the long, thin walled tubing used in the practice of the invention. In addition, the ribs 100 further provide a very pleasing look to the device, and aid in providing an overall attractive looking dressing/grooming accessory device.

While the device of the invention is preferably all made of a suitable plastic material capable of being molded, except for the "wire" button threader and metallic ball chain (although even these elements can be made of plastic), other suitable materials, such as metals and/or alloy materials may be employed. If a plastic is utilized, the device may be finished by plating all exterior portions with simulated precious metals, such as gold, silver and the like. It will also be appreciated that while the zipper pull 22 is suitably desired in juxtaposition with end cap 16, it can be reversed or substituted for that of the dressing/grooming aids located in juxtaposition to the end cap 14.

Although the present invention has been described in some detail by way of illustration and example for purposes of clarity and understanding, it will, of course, be understood that various changes and modifications may be made in the form, details, and arrangements of the parts without departing from the scope of the invention as set forth in the following claims.

What is claimed is:

1. A personal dressing device/valet having dressing aids, comprising: a pair of end caps, and an intermediate element having at least one compartment, and having opposite ends, and at least one of said end caps being removably securable to one of said opposite ends; one of said pair of end caps having clamping means comprising a pair of jaws for assisting in fastening a bracelet to one's wrist; and said at least one of said end caps having another dressing aid selected from the group consisting of a zipper pull, button threader, emery board, magnifying glass and combinations thereof.

2. The personal dressing device/valet according to claim 1, wherein both of said end caps are removably securable to said opposite ends.

3. The personal dressing device/valet according to claim 2, wherein both of said end caps are threadably secured to said intermediate element.

4. The personal dressing device/valet according to claim 2, wherein both of said end caps are frictionally secured to said intermediate element.

5. The personal dressing device/valet according to claim 2, wherein each end cap of said pair of end caps has at least one dressing aid selected from the group consisting of a zipper pull, button threader, emery board, magnifying glass and combinations thereof, receivable within said at least one compartment when said end caps are secured to said intermediate element.

6. The personal dressing device/valet according to claim 5, wherein at least one of said end caps having a zipper pull.

7. The personal dressing device/valet according to claim 6, wherein said one of said pair of end caps having in addition to said clamping means a button threader secured thereto.

8. The personal dressing device/valet according to claim 7, wherein said button threader is centrally disposed and comprises a flexible wire loop of elongated configuration.

9. The personal dressing device/valet according to claim 8, wherein said one of said pair of end caps additionally including at least one slot means for removably securing a replenishable emery board.

10. The personal dressing device/valet according to claim 9, further including a pair of slot means, one for removably securing said emery board, and the other for removably securing a magnifying glass.

11. The personal dressing device/valet according to claim 8, wherein said flexible wire loop is fixedly secured to said one of said pair of end caps.

12. The personal dressing device/valet according to claim 7, including a flat sleeve removably disposed about said button threader comprising a flexible wire loop.

13. The personal dressing device/valet according to claim 12, wherein said zipper pull is a metallic ball chain.

14. The personal dressing device/valet according to claim 12, wherein said zipper pull is a plastic ball chain.

15. The personal dressing device/valet according to claim 6, wherein said zipper pull comprises a ball chain secured at one end thereof to one of said end caps, and at an end opposite thereto to a hook/clasp having a pivotable arm for hooking onto a zipper pull of a garment.

16. The personal dressing device/valet according to claim 2, wherein said intermediate element is provided on its exterior surface with a plurality of longitudinal ribs.

17. The personal dressing device/valet according to claim 2, wherein at least one of said end caps is provided with a plurality of circular grooves with juxtaposed ribs.

18. The personal dressing device/valet according to claim 1, including an enlarged thumb depressor on one of said pair of jaws which is pivotably depressible for providing clearance to a bracelet to be held in place between said pair of jaws while assisting in mounting a bracelet to one's limb.

19. The personal dressing device/valet according to claim 1, wherein said intermediate element, said pair of end caps and said clamping means are all made of a plastic.

20. The personal dressing device/valet according to claim 19, wherein said plastic is plated with a color that simulates gold in appearance.

* * * * *